US005269504A

United States Patent [19]

Backman

[11] Patent Number: 5,269,504

[45] **Date of Patent: * Dec. 14, 1993**

[54] INSERTION OF SUPPLEMENTS INTO NEWSPAPERS

[75] Inventor: Ralf Backman, Eksjö, Sweden

[73] Assignee: Idab Wamac AB, Sweden

[ * ] Notice: The portion of the term of this patent subsequent to Nov. 24, 2009 has been disclaimed.

[21] Appl. No.: 941,270

[22] Filed: Sep. 4, 1992

Related U.S. Application Data

[63] Continuation of Ser. No. 687,889, Jun. 3, 1991, Pat. No. 5,165,672.

[30] Foreign Application Priority Data

Jun. 10, 1989 [SE] Sweden ..... 8903283

[51] Int. Cl.[5] ..... B65H 5/30

[52] U.S. Cl. ..... 270/55; 270/57

[58] Field of Search ..... 270/54, 55, 57

[56] References Cited

U.S. PATENT DOCUMENTS

| | | | |
|---|---|---|---|
| 1,951,300 | 3/1934 | Zimmer | 270/55 |
| 2,461,573 | 2/1949 | Schweizer | 270/55 |
| 3,122,362 | 2/1964 | Vollrath et al. | 270/57 |
| 3,711,083 | 1/1973 | Cantrell, Sr. | 270/55 |
| 4,046,367 | 9/1977 | Merker et al. | 270/55 |

*Primary Examiner*—Edward K. Look

*Assistant Examiner*—John Ryznic

*Attorney, Agent, or Firm*—Ostrolenk, Faber, Gerb & Soffen

[57] ABSTRACT

A method of inserting supplements into newspapers or magazines (20) and a general method of opening newspapers or magazines prior to the insertion process entail separate newspapers being transported in open state through an insertion station. The spines of the newspapers are held in firm contact with pocketlike holders (14, 45) on a conveyor (10) and the holders (14, 45) are caused to temporarily open when they pass the insertion station (60, 61), the firm contact between newspaper (20) and holders being still maintained. Apparatus for performing the method comprises a conveyor (10) and an insertion arrangement (60, 61) with means (14, 21, 22, 23, 25, 26) to open each newspaper (20) and means (60, 61) to insert a supplement into the opened newspaper. The apparatus may also include a second conveyor (40) with separate grippers (45) for each newspaper. The conveyor (40) extends through the conveyor (10). The apparatus also includes means (P11, P12, P13) to temporarily open each gripper during its passage through the insertion station (60, 61; P12) of the insertion equipment. The apparatus furthermore includes means (46) to maintain orientation and position of the newspaper in relation to the gripper (45) while the latter is open in the insertion station (P12).

9 Claims, 3 Drawing Sheets

INSERTION OF SUPPLEMENTS INTO NEWSPAPERS

This application is a continuation of application Ser. No. 07/687,889 filed Jun. 3, 1991, now U.S. Pat. No. 5,165,672.

The invention relates to a method of inserting supplements into a newspaper or magazine, the newspapers or magazines being conveyed through insertion equipment in which they are caused to pass individually in open state through an insertion station where a supplement is inserted into the open newspaper, an opening procedure prior to the insertion and means for performing said procedure.

The insertion of supplements into daily newspapers is a process that has undergone considerable development in recent years. From being performed manually, the process has now developed into one that is even connected on-line to the printing press. The need for reliability is thus greatly increased, since disturbances in the process are extremely expensive.

The insertion technique currently utilized entails the newspaper produced in the press being transported by one or more conveyors to an insertion machine where it is then surrendered. The newspaper (main product) coming straight from the press is aligned in the insertion machine so that individual main products are opened with the aid of special opening mechanisms enabling one or more supplements to be inserted into the opened newspaper. The newspaper is then folded together and the complete product is carried out of the insertion machine by a new conveyor.

The process has proved complicated, extremely product-dependent and sensitive to disturbances. This results in reduced capacity, wastage of newspapers and limited reliability.

An extremely critical stage is, when the main product is to be passed from the feeding conveyor to the insertion machine. Deficiencies at this point may result in the newspaper lying incorrectly in the insertion machine, with the risk of stoppage, loss of newspapers and an unreliable insertion function or none at all.

An example of conventional technology is the use of an insertion machine comprising a continuous conveyor with generally horizontal upper part. Pockets opening outwards are fitted externally on the conveyor. The newspaper is inserted into a pocket with its spine facing down and at one free edge (that opposite the spine) one half of the paper usually protrudes a few millimeters past the other half. One wall of the pocket may be provided with a clamp clamping the protruding edge of the newspaper half against the adjacent pocket wall, and both walls can be hinged to permit opening of the paper. The pockets with opened newspapers then pass beneath a supplement feeder which inserts a supplement into the opened newspaper. Of course several supplement feeders may be arranged one after the other if several supplements are to be inserted into each newspaper. After insertion of the supplements the pocket is closed and the newspaper with supplements is gripped to be carried away by another conveyor.

The newspaper itself is fed into its pocket by an arrangement which is in principle a supplement feeder.

When the newspaper itself is surrendered to the insertion machine, i.e. to a pocket therein, the newspaper is released from its feeder and is unrestrained until it has been caught by the pocket and its accessories. Thus, from an uncontrolled position, each newspaper must be synchronized to a well defined position in which it is to be opened. However, obviously the newspaper frequently gets caught, is located askew or is displaced in relation to the pocket. This not only affects the position of the supplement in the newspaper, but may also cause disturbance in feeding the newspapers interrupted operation, etc. Orientation and position of the newspaper differ, which is reflected in the resultant flow of papers and this in turn leads to increased risk of disturbances in following steps.

One object of the present invention is therefore to eliminate or reduce the above-mentioned inconveniences.

Another object of the invention is to effectivise opening of the newspapers to be provided with supplements, in a manner requiring less apparatus and less space for the machinery for opening the newspapers.

These and other objects and advantages of the invention are achieved by the features defined in the appended claims.

The invention can be considered as encompassed in the concept of avoiding in the proper sense surrendering the newspapers from a supply conveyor to an insertion machine and instead transporting the newspapers with the aid of a conveyor provided with holders, thus ensuring that the newspapers are aligned in a fixed position throughout in relation to the holders, while the holders and newspapers are conducted through an insertion machine which may in principle be of conventional structure (with the deviations and modifications described below). The supplements must be inserted into the newspapers right down to the spine to ensure that they will accompany the newspapers. The holders on the conveyor must therefore be temporarily opened. Holders and newspapers are then aligned so that the newspapers are firmly retained in the holders even when open.

The holders and newspapers may be so orientated, for instance, that the newspapers stand in each holder (i.e. rest steadily in the holders due to the force of gravity), whereas the opened grippers, each containing a newspaper, pass through an insertion machine where the newspapers may be opened and one or more supplements inserted into the opened newspaper. Since each newspaper rests steadily with its spine in the momentarily opening holder, its position and orientation in relation to the gripper will not be altered. When the supplements have been inserted into the newspaper, the holder will close around the spine of the newspaper and the supplement inserted therein, so that newspaper and supplement can be transported further while still retaining their position and orientation in relation to the holder.

The critical stage of surrendering the newspapers to the insertion apparatus is thus avoided by means of the present invention, and the flow of newspapers remains in engagement with the conveyor which thus passes through the insertion machine.

One embodiment of the invention will now be described with reference to the accompanying drawings.

Figure 1:
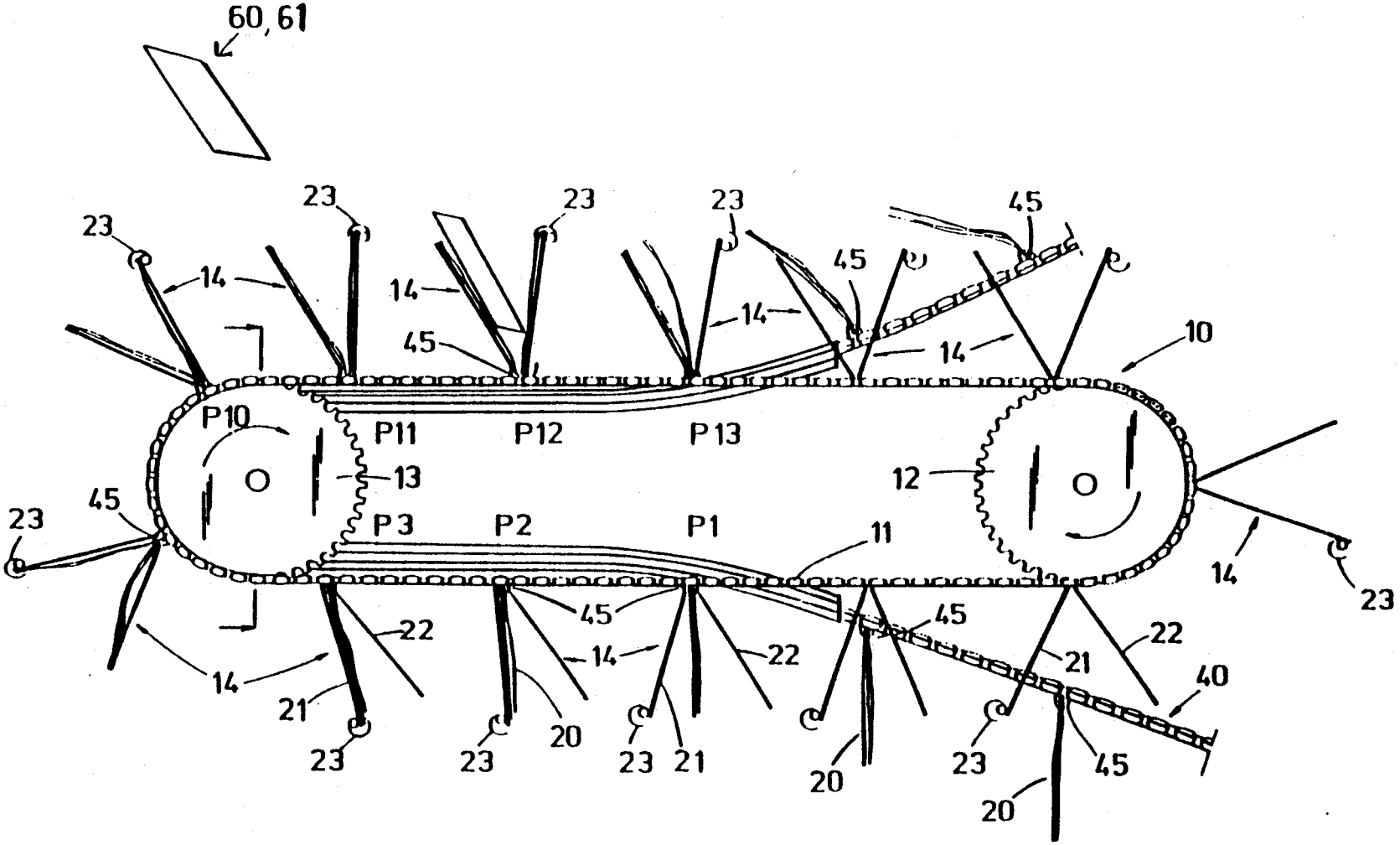
FIG. 1 shows schematically a side view of an apparatus according to the invention.

FIG. 1 shows a first conveyor 10 comprising a chain 11 running around two pulleys 12, 13. The conveyor 10 is provided with pockets 14, each of which receives a newspaper 20, its spine facing the bottom of the pocket. The pocket 14 has a front and a rear support wall 21, 22. At least the front wall is provided with a clamp 23 to temporarily clamp the free edge of the front half of the newspaper. At least one of the walls 21, 22 may be hinged and provided with drive means 25, 26 for the hinging movement. These drive means may be edge controls. One half of the newspaper is suitably somewhat longer from spine to edge than the other half, this longer half being preferably arranged on the wall with the clamp. When a newspaper has been inserted into a pocket 14 and one half has been clamped against the wall 21 by the clamp 23, the newspaper can be opened by folding open the walls 21, 22. Extra clamps may possibly be arranged to keep the other half of the newspaper in contact with wall 22. A conveyor, with such pockets and the function described above is well known and is included in a commercially available insertion machine sold under the designation SLS-1000 inserts by GMA Grafic Management Association Inc., Southborough, Mass. USA.

Figure 2:
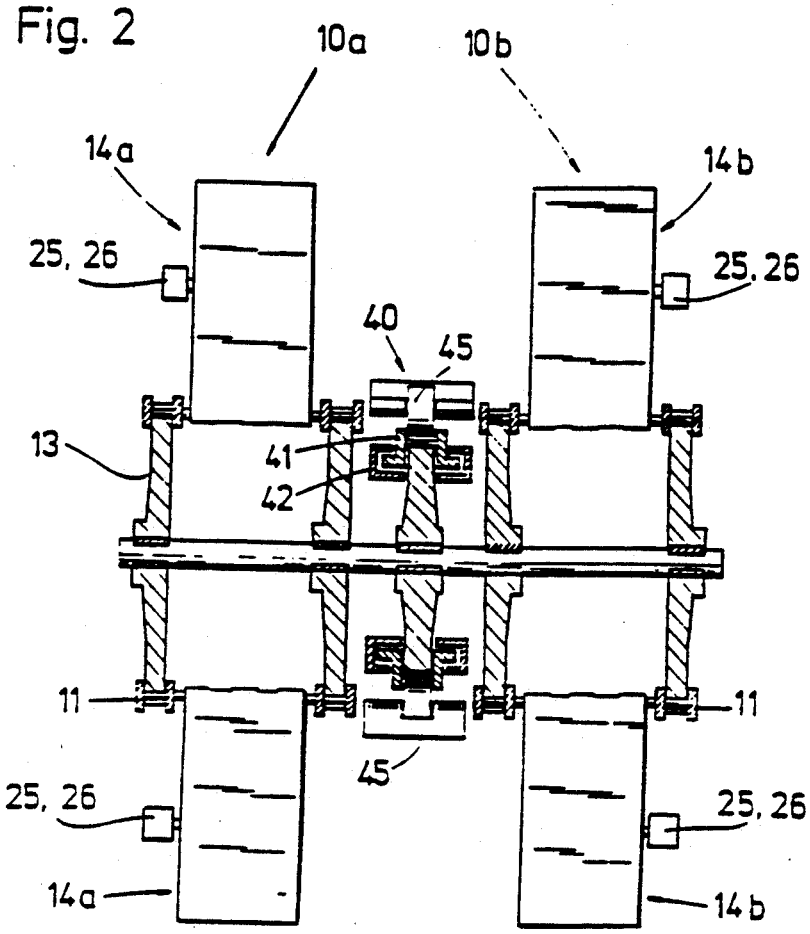
FIG. 2 shows schematically a section taken along the line A—A in FIG. 1.
Figure 4:
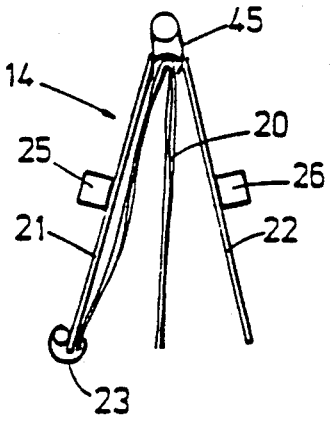
FIG. 4 shows schematically a pocket included in the insertion machine.

Referring to FIG. 2 it is seen that the conveyor 10 according to the invention comprises two substantially parallel parts 10*a*, 10*b* with a space between them for a second conveyor 40.

The principal modification of the pocket conveyor in the known insertion machine SLS-1000 is that it has been cut into two parts with space between them for another conveyor 40.

The two parts 10*a*, 10*b* of the first conveyor 10 are driven synchronously and said pocket 14 comprises two parts 14*a*, 14*b* aligned with each other.

A conveyor 40 is located in the space between the conveyor parts 10*a*, 10*b*. This second conveyor 40 is of the type described in EP-A-0 241 631, for instance, and comprises a series of grippers 45 fitted on a chain 41 running in a channel section 42.

Figure 3:
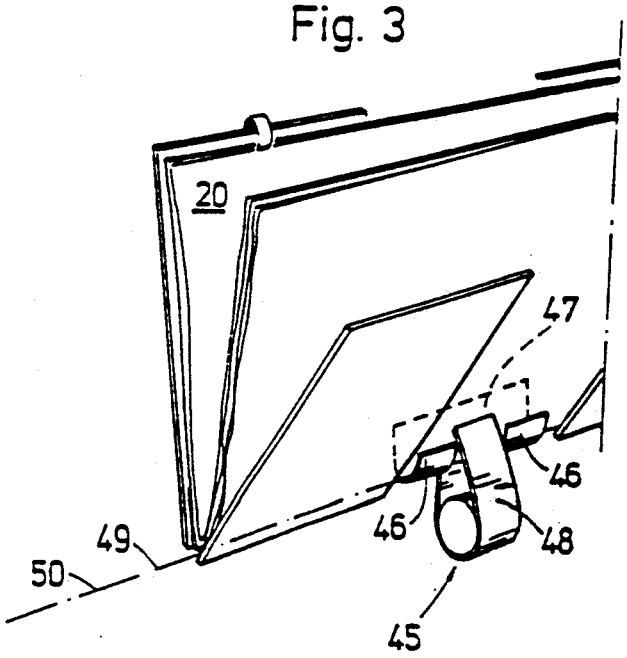
FIG. 3 shows schematically a holder known per se which can be used for the newspaper conveyor forming a part of the equipmment according to the invention.

As can be seen in FIG. 3, each gripper 25 has a support 46 to firmly receive the spine of a newspaper. The gripper is provided with two collect jaws 47, 48 which grip across the spine of the newspaper and between which the newspaper can be clamped.

One collect jaw of the gripper 45, preferably the fixed jaw 47, may then be provided with two pockets, separated in transverse direction, which form separate support points for the newspaper. The second collect jaw, preferably the movable jaw 48, engages between the two pockets 46 and clamps against said collect jaw 47.

The support 46 of the gripper defines a contact line along the spine of the newspaper.

Reverting to FIG. 1 it can be seen that the conveyors 10, 40 have the same pitch between pockets 14 and grippers 45. It can also be seen that the two conveyors 10, 40 run along the same track along a considerable length of the equipment. The two conveyors 10, 40 are thus aligned in such manner that the support line 49 for the newspapers substantially coincides with the hinge 50 for the opening movement of the pockets 14.

FIG. 2 shows schematically that the chains on the two parts of the conveyor 10 and the conveyor 40 are driven by similar sprockets on a common shaft so that both conveyors 10 and 40 run synchronously and aligned as described.

The newspapers into which supplements are to be inserted arrive clamped by the gripper conveyor and are opened by the opening mechanism of the conveyor 10.

At the upper part of the two conveyors 10, 40 shown in FIG. 1 the pockets pass beneath the supplement feeder 60, 61 which inserts supplements into the open newspapers passing below. At least while the supplement is being inserted into the newspaper to the vicinity of its spine, the grippers of the second conveyor 40 are held open so that the supplement is inserted into the grasp of the grippers.

The feeders 60, 61 feeding out supplements one by one are of known type, such as described in GB 2 071 061-A.

Measures are taken to ensure that the spine of the newspaper remains firmly in the gripper 45 without altering position or orientation in relation to the gripper while the gripper is open. According to the embodiment shown these measures constitute arranging the pockets and grippers to be open at the top during insertion of the supplement, so that the newspaper rests firmly in the gripper while this is open, thus enabling the pocket to stabilize the newspaper also.

When all the supplements have been inserted into the newspaper the gripper is caused to close and the clamps or the like which had retained the paper in the pocket are opened. The two conveyors then diverge and the newspapers (with supplements) continue to the next stage.

At P1 the conveyors 10, 40 have converged. At P2 the front wall of the pocket is swung back past the vertical line. At P3 the protruding front edge of the newspaper half is clamped by clamp 23. When the pocket 14 then swings up to the upper part of the conveyor the newspaper is automatically opened due to the force of gravity. At P10 the rear half of the newspaper may be gripped and retained by suction means, for instance, on the rear wall 22 of the pocket. At P11 the pocket and the newspaper can be (further) opened, the walls of the pocket being hinged apart by cam members 25, 26, for instance. The gripper 45 on the conveyor 40 opens before reaching P12 (at P11, for instance). At P12 supplements are inserted from conventional supplement feeders 60, 61. Prior to or at P13 the gripper 45 closes around the newspaper with inserted supplements. At P13 the conveyor 40 diverges from the conveyor 10.

Allowing the conveyors 10, 40 to run along together in the lower part of the conveyor 10 has certain advantages but is not a necessary part of the invention. Thus the conveyors 10, 40 may cooperate along only a straight portion, such as the upper part of the conveyor 10. In this case P11 is considered as the point at which the newspaper is opened.

Another advantage is gained thanks to the basic concept of the invention, that the two conveyors 10, 40 run synchronously, parallel to each other and with pockets and grippers aligned. If the two conveyors run in a common track from a generally horizontal lower transport part, around a pulley 13 to an upper part, and if the front wall of the pockets 14 is caused to slant slightly backwards as shown as P3 in FIG. 1, the newspaper will be forced by gravity against the front pocket wall 21. If then the front half of the newspaper is closest to the front wall the clamp 23 can grasp it and when the pocket 14 subsequently swings up around the pulley 13 the other half of the newspaper will fall down by its own weight into contact with the rear wall 22 where, if necessary, it can be clamped by suitable means such as suction means or the like.

The advantage of the arrangement described above is that the newspaper is in principle opened when the pocket swings up to the upper part of the conveyor. This means that the insertion process can be started close to the start of the upper, substantially horizontal part of the conveyor. Since the first section of the upper part of the conveyor need not be used for inserting a newspaper into the pocket and for opening the pocket, the first conveyor 10 may be made realitively short.

The pockets on the first conveyor serve partly to support the halves of the newspapers and partly as bases for the clamps 23 and any suction means temporarily retaining the halves of the newspapers against the pocket walls. The walls of the pockets 14 may be hinged as in the known insertion machine SLS-1000.

However, it is in principle possible to omit the hinging facility of the walls in the arrangement described above in which the newspaper is opened by the front wall of the downwardly facing pocket, with the front half of the newspaper clamped to it, being tilted forwards past the vertical line. The hinging facility of the walls in relation to the conveyor chain could be simply omitted provided the chain follows a track which will cause the front wall of the pocket to perform said tilting movement in relation to the vertical.

Alternatively the walls of the pockets may be fixed in relation to each other, in which can the pocket be folded down to its entirety in relation to the direction of travel of the conveyor.

The invention has been described in the above in connection with newspapers and the insertion of supplements therein.

However, it should be evident that the invention is applicable to similar main products other than newspapers, as well as to flat objects for insertion other than newspaper supplements. Futhermore the invention has been described in connection with newspapers having spines. However, since the newspapers now lie firmly in contact with the grippers throughout the insertion process, it is not strictly necessary for the "newspaper" to be bound along its edge.

The embodiments described above shall not be interpreted in any restrictive way, but serve primarily to illustrate the invention.

The technique for opening newspapers revealed herein can also be used to advantage in more conventional insertion processes in which the newspapers are transferred in a more or less controlled manner from a feeder to the pockets of the opening equipment, and after insertion the newspapers are again gripped and removed from the pockets by an adjoining conveyor.

An essential feature of the invention is thus how the newspapers are opened prior to the actual insertion. Starting with the newspapers being inserted individually into radially outwardly open pockets for opening the newspapers, said pockets being located on a continuous conveyor running in the vertical plane, the opening technique is characterised in that the newspaper is inserted into an empty pocket before the pocket is tilted upwards at the transition to the upper part of the conveyor, and that the front part of the newspaper is caused to be retained at the front end of the pocket before the tilting movement is complete. The newspaper is thus opened by means of or with the aid of gravity when the pocket is turned upwards.

The apparatus for opening the newspapers in this manner comprises a continuous conveyor running in the vertical plane and provided with outwardly open newspaper pockets, the characteristic feature of the apparatus being that a newspaper feeder is arranged to insert a newspaper into an empty holder before this is turned to face upwards at the transition to the upper part of the conveyor and that the supply means is arranged to bring the front part of the newspaper into alignment with the retention means at the front wall of the pocket before tilting of the pocket to its upright position in the upper part of the conveyor has been completed.

Once the newspaper has been inserted into the pocket and opened, then the actual insertion can be performed by means of supplement feeders as described above. The newspaper, together with supplements, can then be gripped and removed by a gripping feed-out conveyor substantially as described in U.S. Pat. No. 4,723,770, the teachings of which are thus incorporated herein.

The feed-out conveyor may also by arranged to grip and remove the newspapers while the pockets are still located in the upper, straight part of the conveyor and newspapers can then be fed into the pockets thus emptied. This could be effected by a feeder corresponding substantially to the feeder 60 or 61 in the example according to FIG. 1.

It is possible per se to insert the newspapers at any point between the pockets being emptied and their being tilted to face upwards again. However, certain advantages can be gained if insertion is effected from above into an upwardly facing pocket. The opportunity can then be taken to clamp the front half of the newspaper against the front wall of the pocket when the pocket turns down to the lower part of the conveyor, thus causing the newspaper to be brought into contact with the front wall due to the force of gravity.

In such an embodiment the newspaper feeder is located above the region of the end of the upper part of the conveyor so that, with the aid of gravity, the newspaper will assume a correct position in the pocket. The member for applying the front half of the newspaper against the front wall of the pocket is thus included in the switchover from upper to lower part of the conveyor, and the front half of the newspaper can be retained against the front wall of the pocket by clamps, for instance, located on the front wall of the pocket.

Retaining members are arranged to retain the newspapers in the pockets while the latter face downwards. In one embodiment the retaining members may comprise grippers located at the bottom of the pockets to grip the spine of the newspaper when the pocket faces downwards.

However, it should be evident that other forms of retaining members are also feasable. The members holding the front part of the newspaper against the front pocket wall may, for instance, provide a general retaining function for the newspaper.

Since the newspaper is in principle already open when its pocket is tilted to face upwards, the pocket conveyor may be relatively short. As soon as insertion has been effected, the newspaper can be folded together, thus enabling it to be easily gripped by one end for removal. Folding the newspaper entails primarily that the clamp on the front pocket wall is opened so that the pocket can be closed. Alternatively means can be arranged along the upper conveyor part such as brushes, air nozzles, folding arms or the like, to be brought into engagement with the upper part of the newspaper, preferably so that the folded newspaper is laid against one wall, preferably the rear wall, of the open pocket, to be gripped at a specific point by a feed-out conveyor of the type described in U.S. Pat. No. 4,723,770, for instance.

The pocket is now free and can be supplied with a newspaper to be opened, from a feeder which feeds newspapers one by one into empty pockets passing by. The newspaper feeder may, for instance, correspond to the feeder 200 in U.S. Pat. No. 4,723,770. In the example shown in FIG. 5 pockets 14, open radially upwards, are spaced at regular intervals on a continous conveyor running in vertical plane and comprising a chain 11 running over two pulleys 12, 13, spaced apart, which define an upper horizontal conveyor part 50 and a lower conveyor part 51. In principle, the pockets 14 are the same as in FIGS. 1–4 but need not necessarily be able to flap down in relation to the conveyor chain. At the bottom of each pocket is a gripper 45' which is connected to the conveyor 11 and follows the pocket. The grippers 45' are controlled to retain the newspapers in the pockets when the pocket faces downwards. Supplement feeders 60 and 61 are arranged above the upstream end of the upper conveyor part 50 to feed supplements down into the opened newspapers in the pockets which have been tilted to face upwards in the upper part of the conveyor. It will be understood that additional aids for opening the newspapers, such as air nozzles, brushes, mechanical arms or the like may be used in addition to the newspaper-opening technique described here. When the pockets have passed the supplement feeders, the newspaper is folded together, whereupon the primary clamp 23 is opened and schematically indicated means 70 may also be arranged along the upper part of the conveyor in order to assist in closing the newspapers. The means 70 may be air-blowing nozzles, brushes, members for temporarily closing the pocket, or the like. The folded newspaper is caused to lie against the rear wall of the open pocket and can be gripped by one end by a feed-out conveyor 80 which may include a chain 82 running over a pulley 81 at a point when the newspaper is to be gripped, the chain carrying the gripper 83. The conveyor 80 is synchronized with the conveyor 11 enabling the grippers 83 to correctly grip the newspapers 20 in the pockets passing on the pulley 81.

The emptied pocket, still in the upper part 50 of the conveyor, now passes beneath a newspaper feeder 200 which feeds a newspaper, spine first, down into the botton of the pocket. There the newspaper spine is gripped by the gripper 45'. When the pocket tilts downwards towards the lower part 51 of the conveyor, the newspaper will come to rest against the front wall of the pocket and a clamp 23 can be activated to grip the front half of the newspaper and retain it against the front wall 21 of the pocket. One half of the newspapers 20 is generally a few millimeters longer than the other half and the newspapers are therefore orientated in the feeder 200 so that the longer half will be to the fore in the direction of transport.

When the pocket 14, with the front half of a newspaper clamped against the front wall 21 by the clamp 23, enters the transition area between the upper and lower parts of the conveyor, the force of gravity will cause the rear half of the newspaper to rest against the rear wall 22 of the pocket 14, so that the newspaper is in principle open when the pocket is tilted to face upwards.

The embodiment shown can of course be modified and it will be realised that the newspapers can be fed into the pockets at any desired point between the removal conveyor 80 and before the pocket has turned to upright position. However, if the newspaper feeder is located somewhere in the region where the pocket faces downwards, then the newspaper must be caused by external means to lie with its front part against the front wall of the pocket. This may be achieved, for instance by flapping the front wall of the pocket back past the vertical plane as described in the example according to FIGS. 1–4, thus allowing the front half of the newspaper to be gripped.

Figure 5:
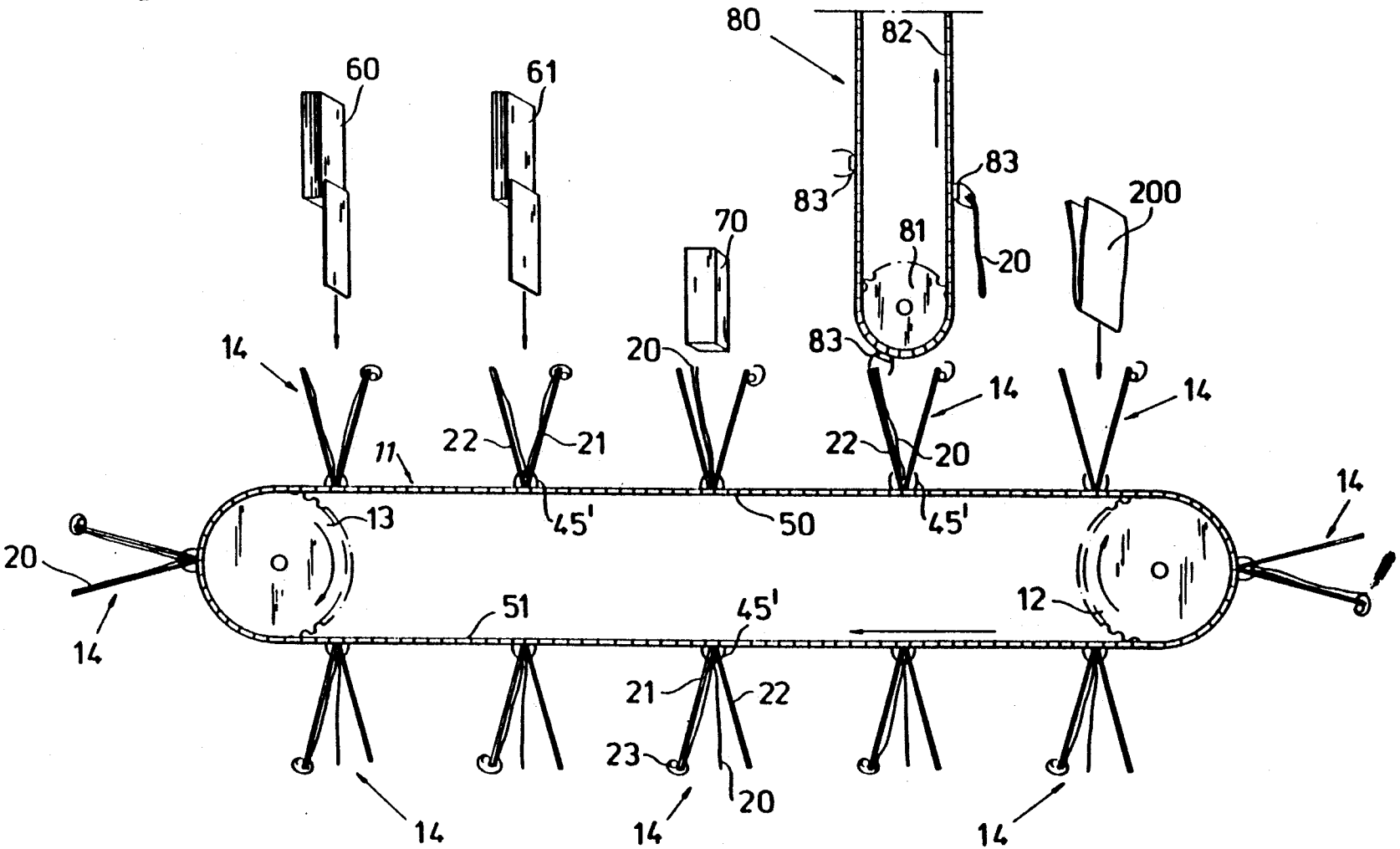
FIG. 5 shows schematically a side view of a newspaper-opening device in conjunction with the insertion equipment.

Certain advantages can thus be gained by feeding the newspaper into the pocket before the front wall of the pocket has passed the vertical plane. One advantage of the opening technique according to FIG. 5 is that the force of gravity can be favourably utilized to open the newspapers. Another advantage is that the conveyor can be made relatively short since the newspapers are in principle open when the pockets are turned upwards to the upper part of the conveyor.

The walls of the pockets 14 may be provided with a central recess at the upper edge to permit the folding member 70 to operate on the central part of the newspaper. It should also be obvious that the gripper 45' may be arranged to act on the longitudinal mid-region of the newspaper spine and that clamps 23 may be arranged on each side of the wall 21.

I claim:

1. A method of inserting supplements into newspapers or magazines, comprising the steps of:

(a) transporting the newspapers or magazines to, through and away from an insertion station by a single gripper conveyor having grippers for holding the newspapers or magazines, the newspapers or magazines having spines, the spines of the newspapers or magazines being held in firm contact with the grippers of the gripper conveyor;

(b) causing the newspapers or magazines to pass by the insertion station in an open state; and (b) temporarily opening the grippers when the newspapers or magazines pass the insertion station to allow insertion of the supplements, while maintaining firm contact between the newspapers or magazines and the grippers.

2. A method as claimed in claim 1, wherein the newspapers or magazines are transported, with spines down, past the insertion station, the spines resting in an upwardly facing support in the grippers.

3. A method as claimed in claim 1, wherein the newspapers or magazines, while being transported by the gripper conveyor, are placed in a pocket having hinged, foldable walls, the spine of each newspaper or magazine being placed at the hinge of the pocket walls.

4. A method as claimed in claim 3, wherein the pockets are attached to a second conveyor, the gripper conveyor and the second conveyor being run parallel from a generally horizontal lower path to a generally horizontal upper path at which the supplements are inserted into the open newspapers or magazines, and wherein the newspapers or magazines are opened by retaining one half of the newspapers or magazine against a front wall of the pocket relative to the direction of travel of the second conveyor, so that the newspaper or magazine opens when the pocket passes from the lower path of the second conveyor up to the upper path of the second conveyor, while the newspaper or magazine is still being held by the grippers.

5. A method of opening newspapers for inserting supplements therein, comprising the steps of:

(a) individually inserting the newspapers into radially outwardly open, downwardly facing, newspaper holders in the form of pockets on a continuous conveyor, each newspaper having a spine, the newspapers being inserted spline first into the holders; and (b) opening the newspapers and conveying the newspapers in an open state through an insertion station, the newspapers being opened by retaining half of each newspaper against a front wall of the holder relative to the direction of the conveying as the newspapers are conveyed from a lower horizontal path to an upper horizontal path, so that the newspapers are opened by gravity as the holder is turned to face upwards.

6. An apparatus for inserting supplements into newspapers or magazines, comprising:

a single gripper conveyor, the gripper conveyor carrying the newspapers or magazines one by one to, through, and away from insertion equipment;

means for opening the newspapers or magazines comprising a second conveyor carrying a plurality of pockets each formed of two parts with a space therebetween, wherein the gripper conveyor runs in the space between the two parts, the gripper conveyor and the second conveyor being arranged to run on a parallel track along a substantial portion of the insertion equipment;

means for temporarily opening each gripper as it passes an insertion station in the insertion equipment;

means for maintaining orientation and position of the newspapers or magazines in relation to the grippers while the grippers are open in the insertion station; and means for inserting a supplement into the opened newspapers or magazines.

7. An apparatus for inserting supplements into newspapers or magazines, comprising:

a single gripper conveyor provided with separate grippers for each newspaper or magazine, the gripper conveyor transporting the newspapers or magazines to, through, and away from insertion equipment, the grippers being arranged to maintain firm contact with spines of the newspaper or magazines;

means to open each newspaper or magazine;

means to temporarily open each gripper as the gripper passes through an insertion station in the insertion equipment;

means to maintain orientation and position of the newspaper or magazine in relation to the gripper while the gripper is open at the insertion station; and means for inserting a supplement into each opened newspaper or magazine at the insertion station.

8. The apparatus as claimed in claim 7, wherein the means for opening the newspapers or magazines comprises a second conveyor driven synchronously with the gripper conveyor, the second conveyor having pockets which face downwardly as the second conveyor passes along a lower horizontal conveyor path, the pockets having a front wall relative to the direction of movement of the second conveyor, the front wall being arranged to slope downwardly and backwardly so that the newspaper or magazine rests against the front wall as the second conveyor passes along the lower horizontal conveyor path, and wherein a retaining member is arranged to retain a front half of the newspaper or magazine against the front wall of the pocket as the newspaper is opened when the pocket is swung forwards past a vertical plane from the lower conveyor path to an upper horizontal conveyor path.

9. An apparatus for opening newspapers or magazines to insert supplements, the newspapers or magazines being inserted one by one into radially upwardly open newspaper holders in the form of pockets on a continuous conveyor, the newspapers or magazines being conveyed in an open state through an insertion station, wherein a front wall of each pocket relative to the direction of movement of the conveyor is arranged to slope downwardly and backwardly as the conveyor passes through a lower horizontal path so that the newspaper or magazine rests against the front wall, and wherein a retaining means is arranged to hold a front half of the newspaper or magazine against the front wall of the pocket, the newspaper thereby being opened when the pocket is swung forwards past a vertical plane from the lower horizontal conveyor path to an upper horizontal conveyor path.

* * * * *